United States Patent [19]

Rhoads

[11] Patent Number: 4,591,131

[45] Date of Patent: May 27, 1986

[54] DRAW WORKS TRAVELING BLOCK MOTION CONTROL APPARATUS

[76] Inventor: Gerald A. Rhoads, 1335 Eighth Ave., Yuma, Ariz. 85364

[21] Appl. No.: 660,433

[22] Filed: Oct. 11, 1984

[51] Int. Cl.[4] ..... B66D 1/56; G05G 1/04

[52] U.S. Cl. ..... 254/269; 74/524; 254/379

[58] Field of Search ..... 254/269, 270, 335, 379, 254/378, 375; 74/524

[56] References Cited

U.S. PATENT DOCUMENTS 2,241,274 5/1941 Severson ..... 254/269

2,564,457 8/1951 Wilson ..... 254/269

3,940,577 2/1976 Christofer ..... 254/269 X

*Primary Examiner*—Stuart S. Levy

*Assistant Examiner*—Katherine Matecki

*Attorney, Agent, or Firm*—Cahill, Sutton & Thomas

[57] ABSTRACT

The upward and/or downward travel of a traveling block in a derrick is controlled to prevent travel beyond normal, safe operating limits. A control line is positioned across the vertical movement axis of the traveling block and upon being moved by the traveling block will actuate sensors to brake and deactivate the draw works, in the event the traveling block traverses beyond safe predetermined limits.

8 Claims, 8 Drawing Figures

DRAW WORKS TRAVELING BLOCK MOTION CONTROL APPARATUS

BACKGROUND OF THE INVENTION

The invention is directed to the control of the upward and or downward motion of a traveling block used in conjunction with oil well drilling derricks, work-over rigs, cranes, or similar hoisting systems.

In one embodiment, the device of this invention is a safety aid installed on a derrick to control the distance a traveling block may be raised in the derrick and thus eliminate the possibility of damaging the crown block and creating a hazard to workers below. In addition, it has been desirable, as a safety measure, to prevent undue lowering of the traveling block to protect the rig floor, and thus, provide safety to the personnel on the rig floor. The systems and devices known heretofore have been based upon sensing the position of a secondary element of the system, i.e., the traveling block wire line, as it is being wrapped onto a draw works drum. The problem with such systems is that with adjustments or changes in the line used in supporting the block, corresponding adjustments must be maintained to the position of the sensing element. The adjustment has to be done on a trial-and-error basis and requires a considerable amount of time.

SUMMARY OF THE INVENTION

It is an object of this invention to provide apparatus for limiting the upward and/or the downward travel of a traveling block used in derricks.

A further object of the invention is to provide an apparatus for controlling the rotary draw works as a function of sensing the actual position of a traveling block if it is too high or too low in the derrick.

A further object of the invention is to provide a means, based upon the actual position of a traveling block in a derrick, to engage the draw works brake automatically in either an upward or downward direction so as to respectively protect the crown block and the rotary rig floor and, more importantly, the personnel located on the rig floor.

Specifically, the invention is directed to an apparatus for limiting the vertical movements of a traveling block in a derrick such as is used in a oil well drilling rig and/or a production work-over rig, the movement of the block being controlled by a clutch and brakeable powered driven wire line draw works or drum that is located on or adjacent a rig floor of the derrick. A first guide is attached to the derrick along with a vertically oriented guide tube that is attached to the derrick below the first guide. The first guide is preferably in the form of a sheave or pulley. A counterweight is reciprocally located within the guide tube. A second guide is attached to the top of the counterweight. A sensor means, e.g. switch, is positioned on the guide tube to sense a "go" or "no-go" location of the counterweight in the guide tube. A wire line extends across the path of the vertical movement of the traveling block from a dead end guide that is affixed to the derrick or to the block opposite the first guide. The wire line then extends around the first guide and the second guide to an affixed point for the other end of said wire line. A servo-like mechanism is caused to be actuated by a signal from the sensing means to inactivate or to halt further movement of the draw works as a function of the no-go location of the counterweight.

DETAILED DESCRIPTION OF THE PREFERRED EMBODIMENT

Before explaining the present invention, in detail, it is to be understood that the invention is not limited in its application to the details of construction and arrangement of parts illustrated in the accompanying drawings, since the invention is capable of other embodiments and being practiced or carried out in a variety of ways. Also, it is to be understood that the phraseology or terminology employed herein is for the purpose of description and not of limitation.

Figure 1:
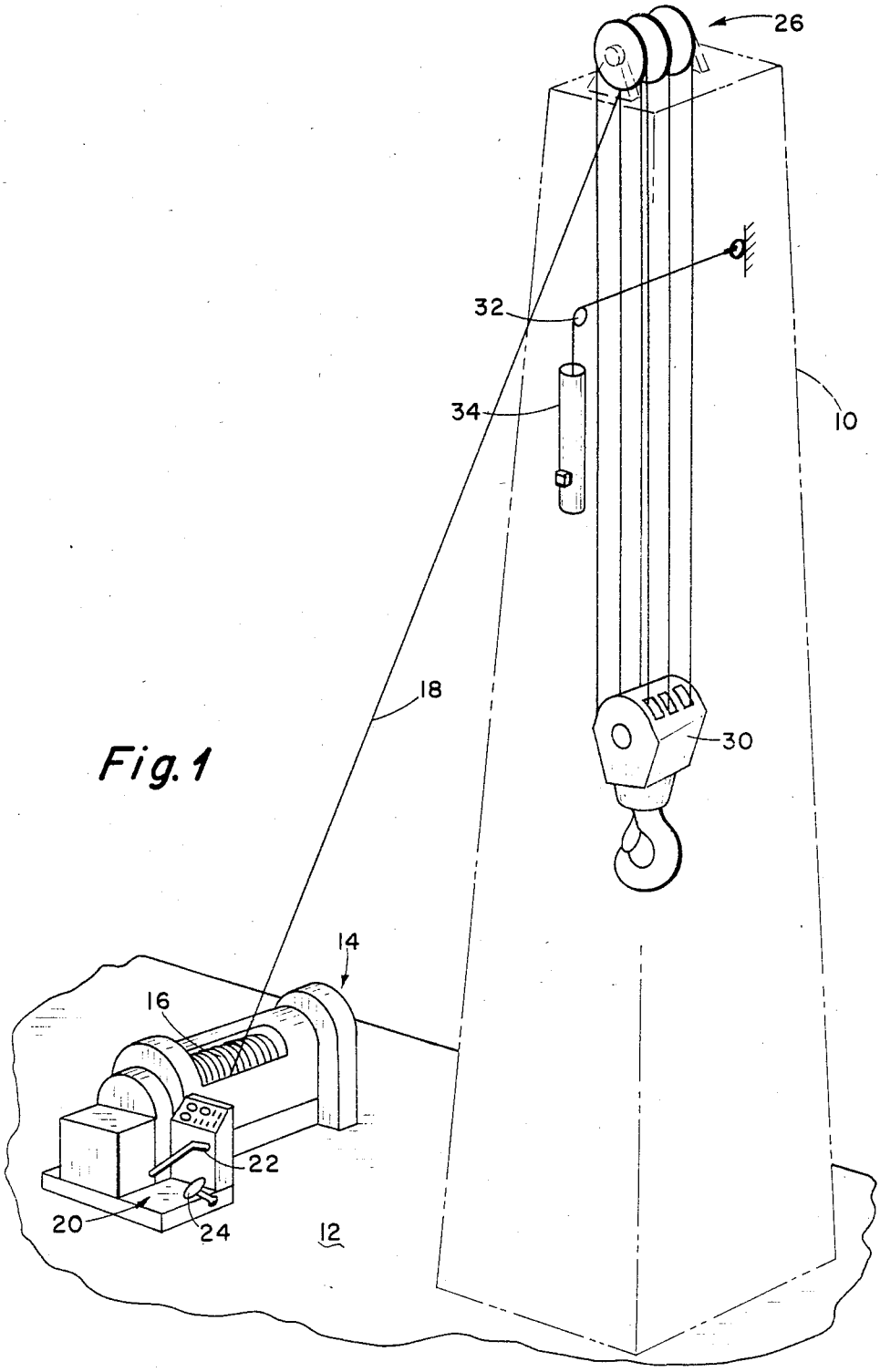
FIG. 1 is a perspective view and general layout of the invention relative to a rig floor, draw works, traveling block and derrick.

Referring now to FIG. 1, the apparatus of this invention is typically to be used in conjunction with an oil well drilling derrick 10 that is positioned upon a rig floor 12, having a draw works generally designated by the numeral 14 and which is fairly well standardized in the art. A power supply, not shown, is adpated to control the rotary motion of a drum 16 upon which wire line 18 is wrapped. An operator's position is generally designated by the numeral 20 where, for the purposes of this invention, a draw works brake lever 22 and an accelerator foot pedal and lever 24 are located. The wire line 18 traverses around a crown block generally designated by the numeral 26 and located at the top of the derrick or mast 10, and is adapted to support a traveling block 30 for vertical movement within the derrick 10 in a manner well known to those skilled in the art.

Figure 4:
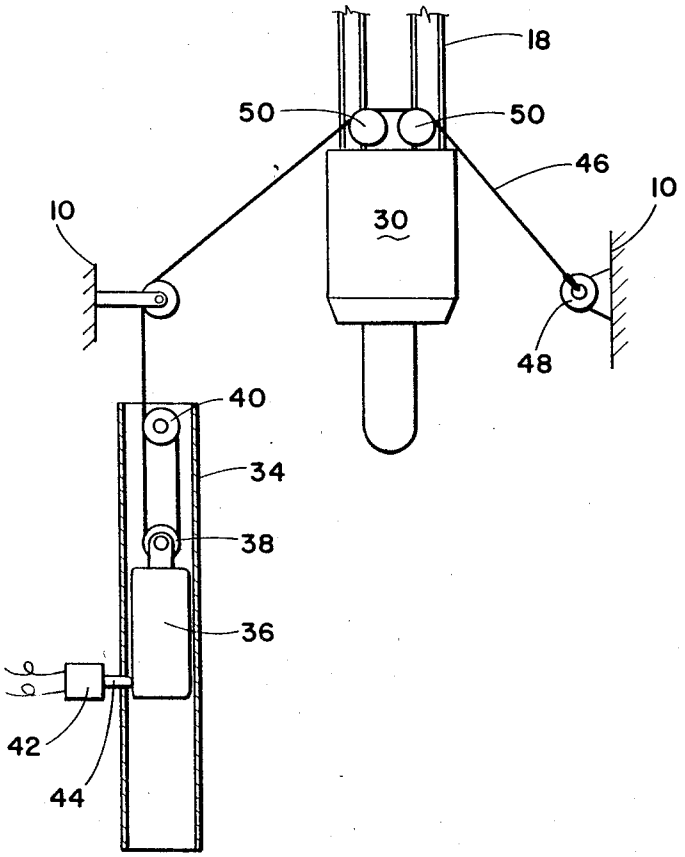
FIGS. 3 and 4 are partial schematic-like views describing the operation of one embodiment of this invention controlling the upward travel of a block.
Figure 3:
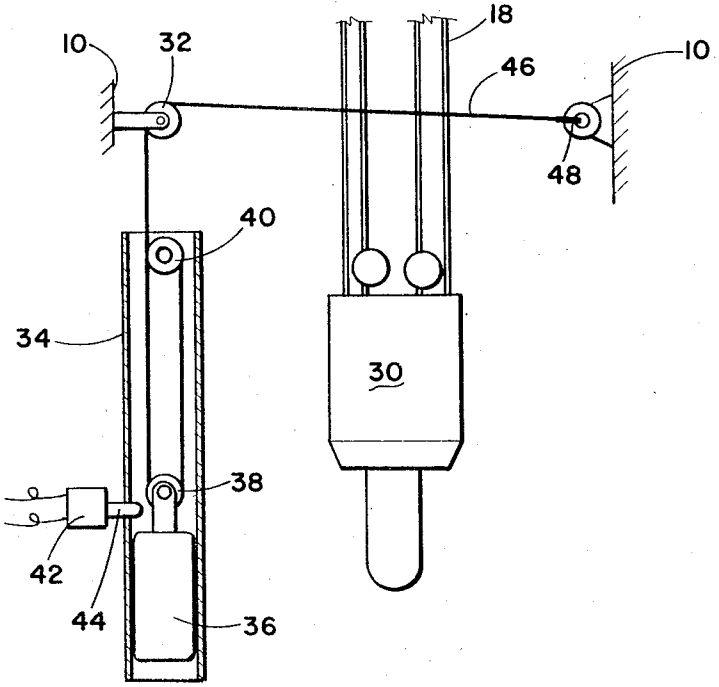

In the embodiment of FIGS. 1, 3 and 4, the apparatus for limiting the upward vertical movement of the traveling block 30 comprises a first guide pulley 32 that is attached to the derrick. A vertically oriented guide tube 34 is located therebelow. Within the guide tube is a counterweight 36 adaptable to reciprocably move within the guide tube 34. A second guide pulley 38 is attached to the top of the counterweight 36 while a dead-end attachment or guide 40 is located in the upper part of the guide tube. A sensing switch 42 is positioned on the guide tube with a toggle 44 adapted to sense a go or no-go location of the counterweight 36 in the guide tube 34. A wire line 46 is affixed to the derrick 10 at one end 48 and extends across the path of vertical movement of the traveling block around first guide 32, second guide 38 to the dead end 40. The traveling block 30 may include one or a plurality of guide rollers 50 for frictionless interception with the wire line 46 during the operation thereof.

Figure 2:
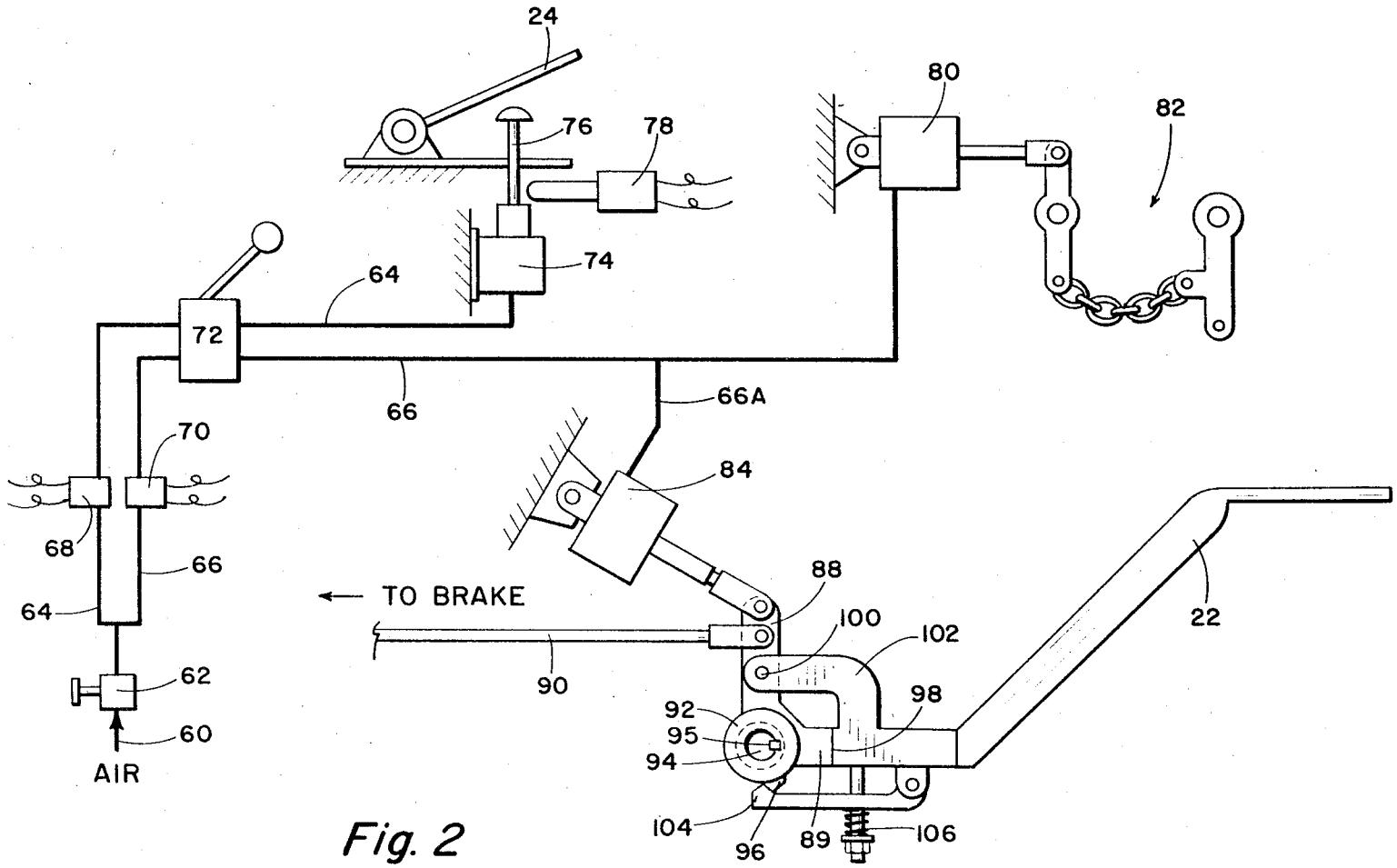
FIG. 2 is a schematic view of the control mechanism for halting and braking the draw works as the results of a no-go signal.
Figure 8:
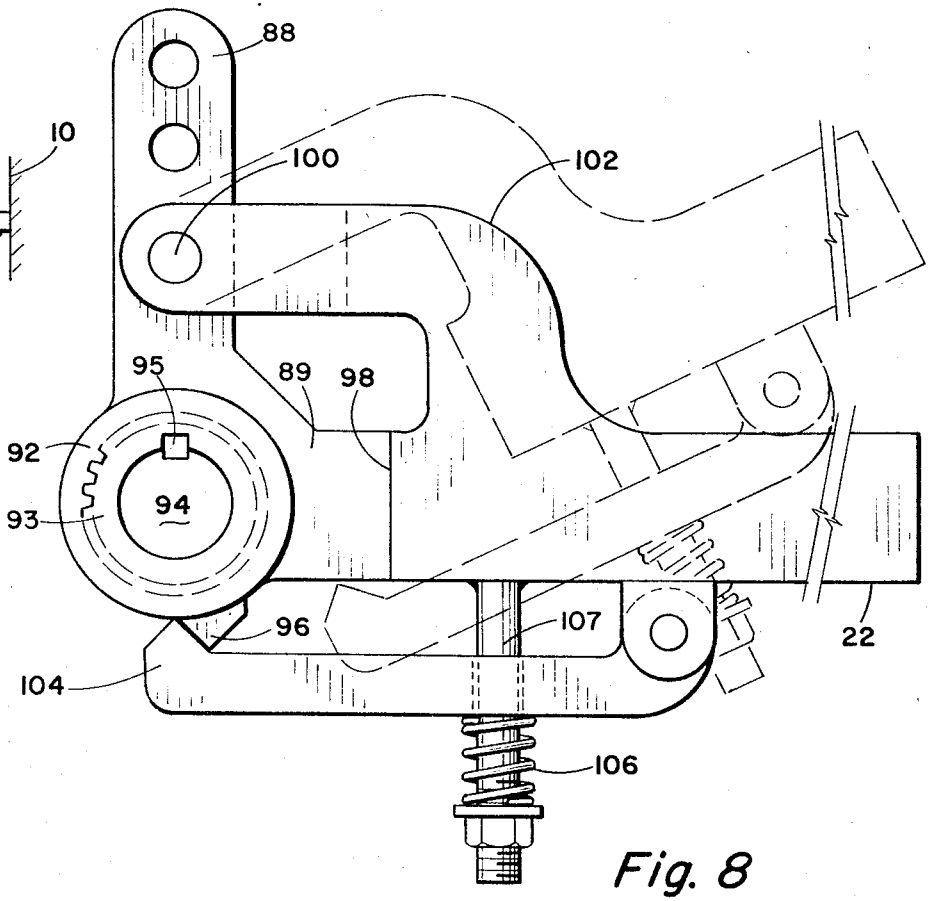
FIG. 8 is an enlarged partial view of the pivotal mechanism of the draw works brake lever utilized as a part of the control mechanism of the invention.

The draw works control mechanism is schematically described in FIG. 2. In this embodiment the system is controlled by pressurized air supplied at 60 through a valve 62 and then divided into supply conduits 64 and 66 which are respectively controlled by solenoid valves 68 ahd 70. A manually actuated air exhuast or release valve 72 is located so as to control the exhaust of air through lines 64 and 66. The air through line 64 operates a cylinder and piston mechanism 74 which extends piston rod 76 upward to restrain the movement of foot throttle or accelerator 24 until the traveling block has resumed a safe altitude. A microswitch 78 is activated by movement of the piston rod 76 which then activates solenoid switch 70 for the passage of air through line 66 to a cylinder 80 which through its linkage disconnects the engine clutch lever, not shown, by way of the mechanism generally designated by the numeral 82. At the same time air will also flow to cylinder and piston mechanism 84 by way of conduit 66A which connects to the brake lever 22 by way of L-shaped lever arm 88 (See FIG. 8). A control arm 90 extends to the brake, not shown, which is typically a friction brake and/or water brake. The lever arm 88 has an interiorly splined hub 92 that connect with a matching splined sleeve 93 that is keyed at 95 to fixed shaft 94. A detenting protrusion 96 is located upon the exterior of the hub 92. The operator's hand brake arm 22 is separated from the horizontal portion 89 of the L-shaped lever arm at 98. The operator's brake arm 22 is pivotally connected to the vertical portion 88 of the lever arm at 100 by way of interconnected off-set yoke-like arms 102. The operator's hand brake arm 22 also includes a pivot arm 104 which is biased inwardly by a spring 106 on pin 107 which is interconnectable, as shown, with the detent 96 so that the motion of the brake arm and the primary lever 88 are in unison. The primary purpose of the mechanism having an operator's brake arm lever 22 that is separated at 98 is to prevent the operator from actuating or releasing the brake until the condition of a safe altitude of the traveling block is reestablished through the system. Although an electro-pneumatic control is shown, an electro-hydraulic system is inclusive of the invention. The purpose of the splined connection 92, 93, 94 is to permit adjustments.

In the operation of the embodiment shown in FIGS. 1, 3 and 4, when a signal is created by the position sensing toggle 44 that the traveling block has reached an excessive height a signal is sent to solenoid air valve 68 thus allowing pressurized air to travel through line 64 first to the cylinder 74 which actuates piston rod 76 upward to override any effort of the operator on the foot throttle or accelerator pedal 24. The result, in effect, is to reduce engine speed and resultant deceleration of the traveling block. The upward movement of rod 76 is sensed by switch 78 which, in turn, will open solenoid valve 70 allowing pressurized air to traverse through conduit 66 to both the clutch release mechanism 80, 82 and to the brake cylinder-piston 84, thus declutching the draw works, setting the brake and stopping further movement of the draw works drum. In the operation of the brake, movement of the primary lever 88 in a clockwise direction will pull the brake lever 90 and thus set the brake. If the operator restrains the hand lever 22, the primary lever 88 and the operator's lever portion 22 as heretofore described will separate at 98 (See FIG. 8, dotted lines). This could also occur in the event an operator tries to release the brake prior to release of pressure to cylinder-piston 84. The speed of operation of the various cylinder-piston elements 74, 80 and 84 may be controlled by valve 62 which may be a needle-type valve or by other valves not shown which may be located in lines 64 and 66.

In order for the operator to regain control he would press down on the operator's lever 22 to reengage catch 104 to detent 96. At the same time or before he would position manual air release valve 72 in such a position to exhaust or deactivate cylinders 74, 80 and 84. Then, after lowering the traveling block by manipulation of the brake lever so that the sensing element 42–44 is no longer sending a signal, the operator can then release air valve 72 and would thus be in full command of the normal operating controls.

Figure 6:
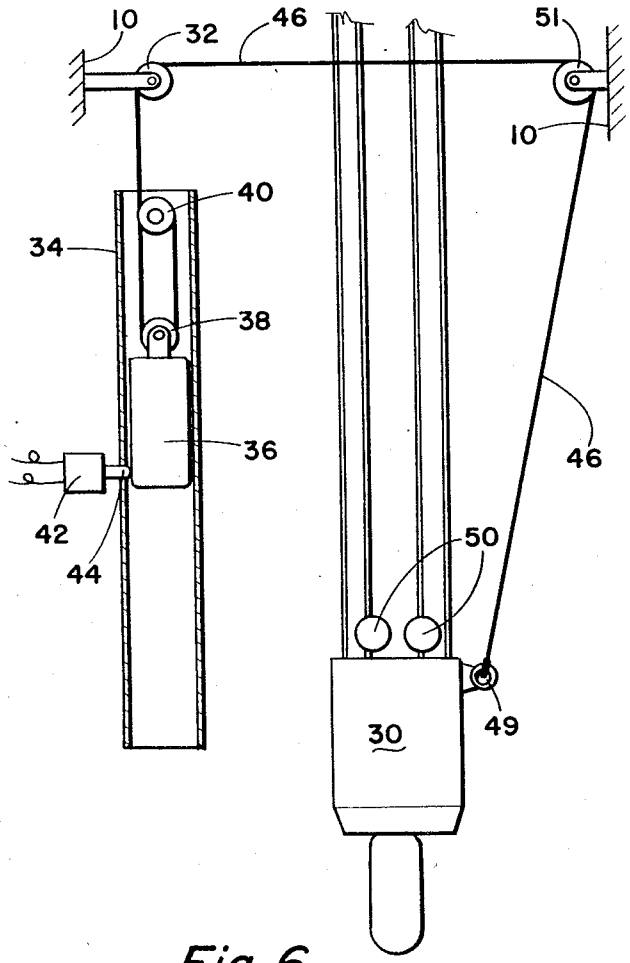
FIGS. 5, 6 and 7 are schematic descriptions of a modified apparatus that will control both the upper and the lower travel of a block.
Figure 5:
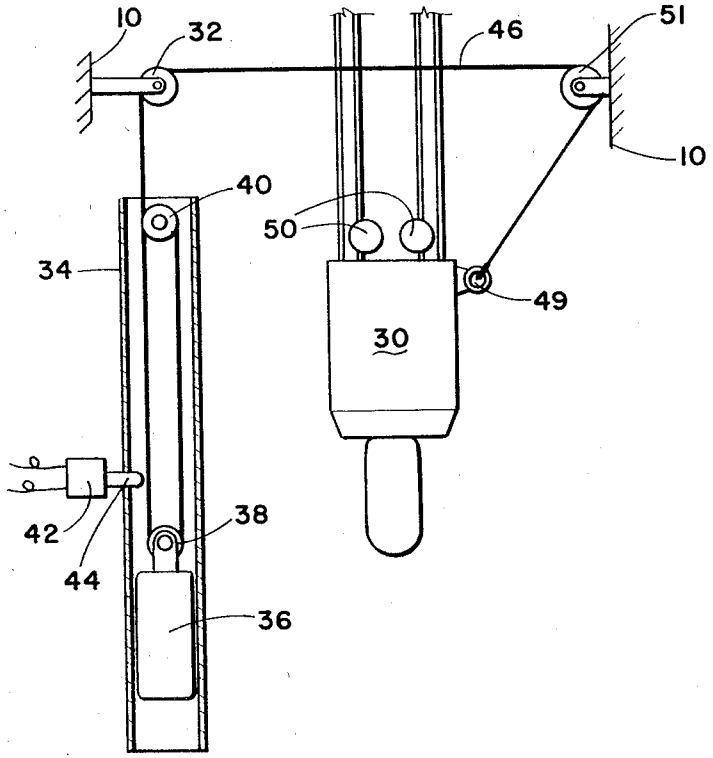
Figure 7:
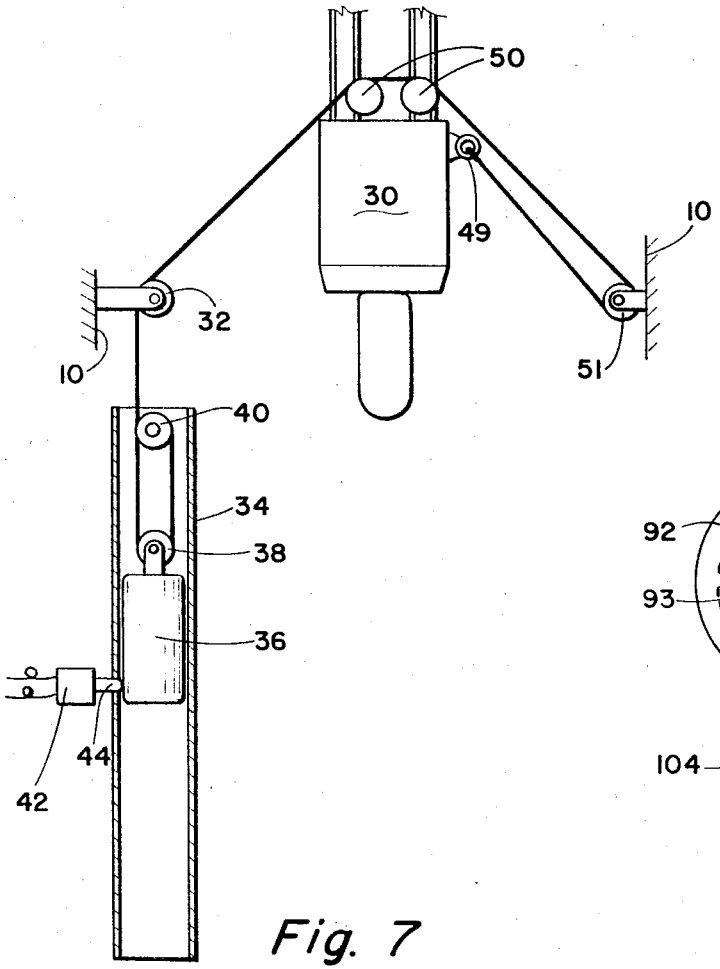

A modified form of the invention is described in FIGS. 5, 6 and 7 for controlling the upward and the downward movement of the traveling block 30. In this embodiment the primary change is to affix one end of wire line 46 to the traveling block at 49 providing a guide pulley 51 to the derrick 10 in lieu of the dead end 48 as shown in the previous embodiment. The movement and operation of the traveling block is substantially similar and like numerals have been utilized for the same or similar part. That is, a first guide tube 34, counterweight 36, second pulley 38 and a dead end guide or pulley 40, a sensing switch 42 and 44 is similarly located as in the previous embodiment. In operation, as the traveling block moves downward to a position as shown in FIG. 6, the control wire line 46 attached to the traveling block raises the counterweight 36 to a first position wherein the switch 42 and its toggle 44 provide a no-go signal to operate the circuit shown in FIG. 2 as previously described. In order for the operator to regain control after the downward movement of the block has been stopped, he would reengage the brake, operate air valve 72 regaining control of the engine throttle and the engine clutch. He would engage the engine clutch for upward travel and raise the block until the no-go signal had been deactivated. At this time, he would release control valve 72 and would have normal control of the operation.

FIG. 7 describes the system in the control of the upward movement of the traveling block and also illustrates the activation of the sensing switch 42 and its toggle 44 in accordance with a no-go situation which will likewise send a signal and operate the braking of the draw works to prevent further upward movement thereof.

What is claimed is:

1. Apparatus for limiting the vertical movement of a traveling block in a derrick, the movement of said travelling block being controlled by a power driven wire line draw works located on or adjacent a floor of said derrick, the draw works including an accelerator and a brake controlled by an operator comprising:

(a) a first guide attached to said derrick;

(b) a guide tube vertically oriented and attached to said derrick below said first guide;

a counterweight reciprocably located within said guide tube;

(d) sensing means positioned on said guide tube to sense the location of said counterweight in said guide tube and to generate a signal upon sensing a predetermined location of said counterweight;

(a) a wire line extending across the path of said vertical movement of said traveling block from a first end of said wire line affixed to said derrick opposite said first guide, thence around said first guide and coupled to a top of said counterweight for raising said counterweight toward said predetermined location when said travelling block engages said wire line; and (f) control means responsive to said signal generated by said sensing means to halt movement of said draw works upon said counterweight reaching said predetermined location.

2. The apparatus recited by 1 further including a second guide attached to the top of said counterweight for coupling said wire line thereto, said wire line extending around said second guide and terminating at a second end opposite said first end of said wire line, said second end of said wire line being secured to an affixed point.

3. Apparatus of claim 2 wherein said first and second guides are wire line pulleys.

4. Apparatus of claim 1 wherein said sensing means to sense said location of said counterweight is an electrical switch.

5. Apparatus of claim 4 wherein said draw works includes an engine clutch and wherein said control means comprises means to deactivate said accelerator, disengage said clutch and actuate said brake.

6. Apparatus for limiting the vertical movement of a travelling block in a derrick, the movement of said travelling block being controlled by a power driven wire line draw works located on or adjacent a floor of said derrick, the draw works including an accelerator and a brake controlled by an operator, said apparatus comprising in combination:

(a) a first guide attached to said derrick;

(b) a guide tube vertically oriented and attached to said derrick below said first guide;

(c) a counterweight reciprocally located within said guide tube;

(d) sensing means positioned on said guide tube to sense the location of said counterweight in said guide tube and to generate a signal upon sensing a predetermined location of said counterweight;

(e) a wire line extending across the path of said vertical movement of said travelling block from a first end of said wire line affixed to said derrick opposite said first guide, thence around said first guide and coupled to a top of said counterweight for raising said counterweight toward said predetermined location when said travelling block engages said wire line;

(f) control means responsive to said signal generated by said sensing means to halt movement of said draw works upon said counterweight reaching said predetermined location;

(g) said control means including automatic means to automatically actuate said brake without causing injury to the operator, said automatic means including:

(i) a rotatable shaft;

(ii) an L-shaped lever arm coupled to said rotatable shaft for rotation therewith, said lever arm having first and second legs extending perpendicular to one another from said rotatable shaft;

(iii) brake actuating control rod coupled to said first leg of said lever arm for applying said draw works brake when said lever arm is rotated in a predetermined direction;

(iv) an operator's hand brake arm pivotally connected to said first leg of said lever arm and separably coupled to said second leg of said lever arm for allowing the operator to rotate said lever arm in said predetermined direction; and (v) hydraulic means coupled to said lever arm and activating in response to said signal generated by said sensing means for rotating said lever arm in said predetermined direction, said separable coupling between said hand brake arm and said lever arm allowing said hydraulic means to rotate said lever arm without rotating said hand brake arm.

7. An apparatus as recited by claim 6 wherein said separable coupling between said hand brake arm and said second leg of said lever arm includes a detent formed upon said lever arm and a spring-biased catch pivotally connected to said hand brake arm, said catch being adapted to engage said detent for allowing motion of said hand brake arm and said lever arm to be in unison when said hydraulic means is not activated.

8. An apparatus for limiting the upward and downward vertical movement of a travelling block in a derrick, the movement of said travelling block being controlled by a power driven wire line draw works located on or adjacent a floor of said derrick, the draw works including an accelerator and a brake controlled by an operator, said apparatus comprising in combination:

(a) a first guide attached to said derrick;

(b) a guide tube vertically oriented and attached to said derrick below said first guide;

(c) A counterweight reciprocably located within said guide tube;

(d) a second guide attached to a top of said counterweight;

(e) a third guide attached to said derrick across from and opposite to said first guide;

(f) an electrical switch positioned on said guide tube to sense the location of said counterweight in said guide tube and to generate a signal upon sensing a predetermined location of said counterweight;

(g) a wire line extending across the path of said vertical movement of said travelling block between said first and third guides, said wire line extending from a first end thereof affixed to said travelling block, around said third guide, thence around said first guide, and thence around said second guide to an affixed point at a second end of said wire line opposite said first end thereof, said wire line raising said counterweight toward said predetermined location when said travelling block moves upward and engages said wire line, said wire line also raising said counterweight toward said predetermined position when said travelling block moves downwardly toward the floor of said derrick; and (h) control means responsive to said signal generated by said electrical switch to halt movement of said draw works upon said counterweight reaching said predetermined location.

* * * * *